United States Patent [19]

Daoust

[11] Patent Number: 4,607,842

[45] Date of Patent: Aug. 26, 1986

[54] EXERCISING APPARATUS FOR USE BY HOCKEY PLAYERS TO PRACTICE THEIR SLAP AND WRIST-SHOTS

[76] Inventor: Real Daoust, 107 Chemin Beauce, Ste-Martine, Quebec, Canada

[21] Appl. No.: 638,241

[22] Filed: Aug. 6, 1984

[51] Int. Cl.[4] ..... A63B 69/00

[52] U.S. Cl. ..... 273/1 B; 273/375; 124/51 R

[58] Field of Search ..... 273/1 B, 369, 376, 375, 273/310, 190, 127 R, 127 B

[56] References Cited

U.S. PATENT DOCUMENTS

| | | | |
|---|---|---|---|
| 2,210,557 | 8/1940 | Schillace et al. | 273/369 |
| 3,419,272 | 12/1968 | Miller et al. | 273/369 X |
| 3,665,910 | 5/1972 | Boni | 273/1 B X |
| 3,709,489 | 1/1973 | Holleran et al. | 273/1 B |
| 3,765,675 | 10/1973 | DiMarzio | 273/1 B |
| 3,794,318 | 2/1974 | Holmes | 273/1 B |
| 3,856,298 | 12/1974 | Frantti | 273/1 B |
| 3,933,354 | 1/1976 | Goldfarb et al. | 273/1 GC |
| 3,955,815 | 5/1976 | Deschesnes | 273/1 B |
| 3,970,310 | 7/1976 | Gryschuk | 273/375 |
| 4,245,843 | 1/1981 | Griggs | 273/1 B X |
| 4,266,776 | 5/1981 | Goldfarb | 273/310 |
| 4,333,657 | 6/1982 | Jaworski et al. | 273/376 |

*Primary Examiner*—Paul E. Shapiro

*Attorney, Agent, or Firm*—Robic, Robic & Associates

[57] ABSTRACT

An exercising apparatus for use by hockey players to practice their shots and improve the accuracy of these shots. The apparatus comprises a lane structure, and a goal structure fixed at one end of the lane. This goal structure includes targets located in each of its corners and lamps associated with each target. A device is provided at the other end of the lane for dispensing pucks one by one on an endless belt. At least one platform is positioned adjacent the endless belt for receiving a hockey player who wants to practice his shots with the dispensed pucks. The platform on which stands the hockey player has an upper surface slightly heightened with respect to the endless belt for simulating, during the exercise, the height of the skates that the hockey player will put on when actually playing on a rink. A control circuit operates the lamps one after the other in any sequential order at substantially the same speed as the one at which the pucks are dispensed, for visually indicating to the players to which target they must try to aim at. This excercising apparatus is particularly interesting in that it allows hockey players to practice their shots as long as they want out of a rink.

10 Claims, 8 Drawing Figures

FIG. 3
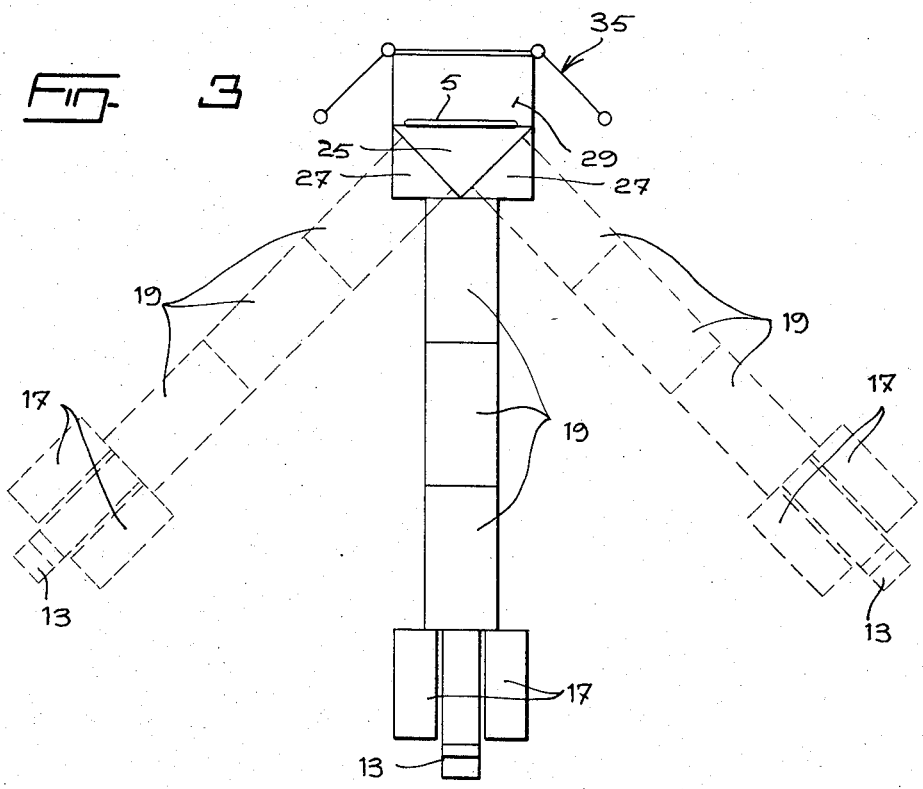
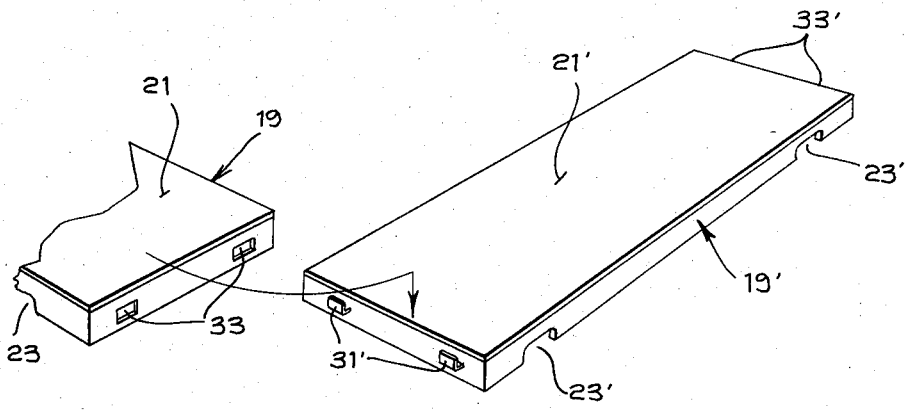
FIG. 2

FIG. 6
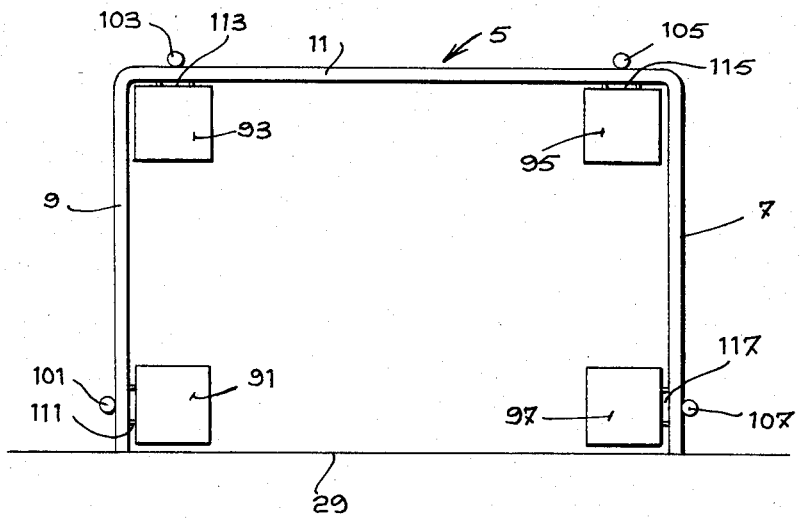
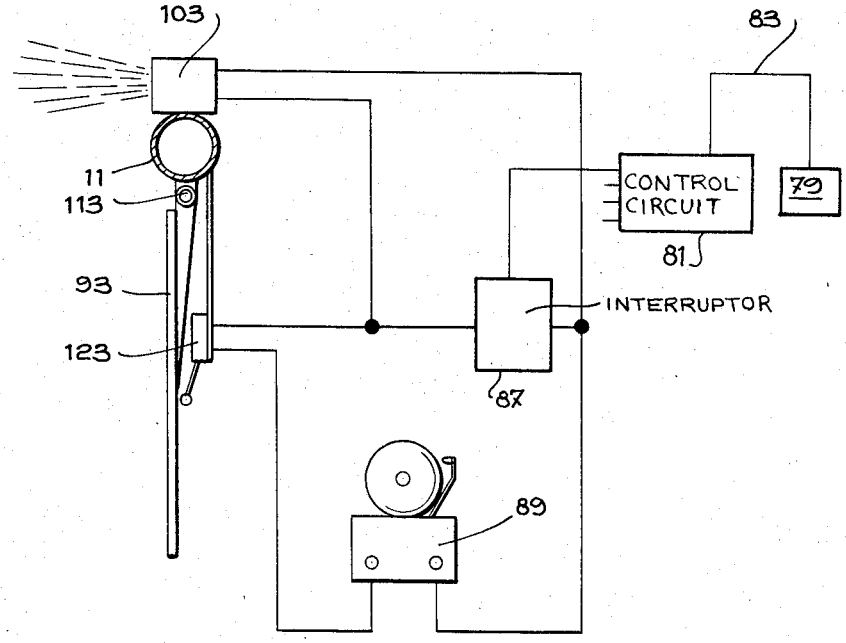
FIG. 7

EXERCISING APPARATUS FOR USE BY HOCKEY PLAYERS TO PRACTICE THEIR SLAP AND WRIST-SHOTS

The present invention is generally concerned with the training of hockey players and more particularly with their practice of slap-shots or wrist-shots onto a rink or outside thereof in order to improve the accuracy of these shots.

In the very particular field of hockey, it is well known that the shot accuracy is directly related to the time spent by the hockey players to practice their shots towards a goal. To improve the accuracy of the shots of a hockey team and accordingly the efficiency of this team, the coach therefore must rent a rink for relatively long periods of time to allow every player of the team to practice his shots. This rent involves substantial costs that are really unecessary inasmuch as, in most of the cases, the players who have to practice their shots do not need to practice their skating.

A first object of the present invention is to provide an exercising apparatus especially designed for allowing hockey players to practice their shots out of a rink in order to improve the accuracy of these shots, while practising under conditions very similar to those encountered when practising onto a rink.

In accordance with the invention, this first object is achieved with an exercising apparatus comprising the combination of:

a lane structure preferably made of a plurality of modular elements provided with fixation means to allow them to be connected end to end;

a goal structure mounted at the end of the lane, this goal structure comprising two vertical post and an horizontal bar of regular dimensions;

a puck-dispensing device located at the other end of the lane for dispensing a plurality of pucks one by one; and at least one platform positioned adjacent to the puck dispensing device for receiving a hockey player who wants to practice his shots and allowing this player to throw each dispensed puck towards the goal structure with a hockey stick.

Advantageously, the upper surface of the platform on which stands the hockey player is positioned at a higher level than the surface on which are dispensed the pucks for simulating, during the exercise, the height of the skates that the hockey player will put on when actually playing on a rink. As a result, the hockey player using the apparatus according to the invention will be practicising under conditions very similar to those encountered when playing onto a rink with skates put on his feet.

According to a preferred embodiment of this first object of this invention, the puck dispensing device com- prises:

a container for storing pucks, this container preferably comprising a vertical hollow tube in which may be stacked up several pucks;

an endless belt extending between the puck container and the end of the lane opposite to the goal structure, for moving each puck delivered from the container to the end of the lane, this endless belt having an upper surface extending in substantially the same plane as the upper surface of the lane; and a pusher operated by a motor for dispensing the pucks one by one from their container onto the endless belt. In this particular embodiment, the motor preferably drives the pusher at regular interval by means of a cam.

Advantageously, the modular elements forming the lane include at least one connecting element for connecting the lane either in aligned position with respect to the axis of the goal structure, or at left or right angle with respect this axis. This particular element advantageously allows the hockey players to practice from any angular position with respect to the goal structure.

In the above description, reference has been made to the practice of shots outside of a rink. If such a practice out of a rink is very interesting, it is also important for the players to practice their shots onto a rink under conditions very similar to those encountered when playing against another team.

Therefore, another object of the invention is to provide an exercising apparatus capable of being substituted for a standard goal structure onto a rink to allow one or several hockey players to practice their shots under conditions very similar to those encountered when playing against another team.

The substitution goal structure is intended to be used in substitution for one of the goals located at either ends of a rink. However, it maybe understood that such a substitution goal structure may also be used onto the above mentioned, apparatus according to the invention for practising shots outside of a rink.

More particularly, the other object of the present invention is to provide an exercising apparatus comprising a goal structure intended to be substituted for a standard goal structure and to be fixed in substantially the same manner directly onto the surface of a rink close to one end thereof. The substitution goal structure comprises two vertical posts and an horizontal bar of regular dimensions, all together defining a frame, and a net fixed behind the frame. At least two vertical targets are fixed either to the posts and/or the horizontal bar so as to extend inside the frame of the goal structure. Visual means are fixed to the posts and/or the horizontal bar outside of the frame of the goal to indicate to the hockey players practicising their shots which one of the targets they must aim at and try to reach. An electronic control circuit is provided for operating the visual means one after each other in any order, even repetitively, at a predetermined speed to force the hockey players to aim at one or the other target in a random manner.

According to a preferred embodiment of the invention, the electronic control circuit is located in a portable box and include an audible signalling system electrically connected to a set of contacts mounted on each of the targets to give an audible signal to the hockey players every time a puck thrown by a player hits the target designated by the visual means.

This portable box can be located behind the goal structure and connected to it by a wire. It can also be located outside of the rink, over the belt, to prevent it from being damaged by accident.

The electronic control circuit may include a manually adjustable device for adjusting the speed at which the visual means associated to the targets are to be successively operated, thereby making it possible to take into account and improve the capacity of the players.

Advantageously, the substitution goal structure is provided with four targets fixed to cover the four internal corners of the goal frame. If desired, use can be made of a fifth, oscillating target suspended to the lower end of a pendulum mounted in the middle of the horizontal bar of the frame. It is obvious that the number of targets and the shape and position thereof only depend on the players or coaches, requirement and can be modified within the scope of the present invention.

The present invention and its numerous advantages will be better understood upon reading of the following non limitative description of two preferred embodiments thereof, made in connection with the accompanying drawings in which:

FIG. 2 is a detailed view showing attachment of the modular elements forming the lane of the apparatus shown in FIG. 1;

FIG. 3 is a top plan view showing three different manners in which the lane can be orientated with respect to the goal structure, in view of practicising from different angles;

FIG. 6 is a top plan view of the goal structure mounted at the end of the lane;

FIG. 7 is a diagram of the electronic control circuit used for forcing a player to aim at a given target mounted onto the goal.

Figure 1:
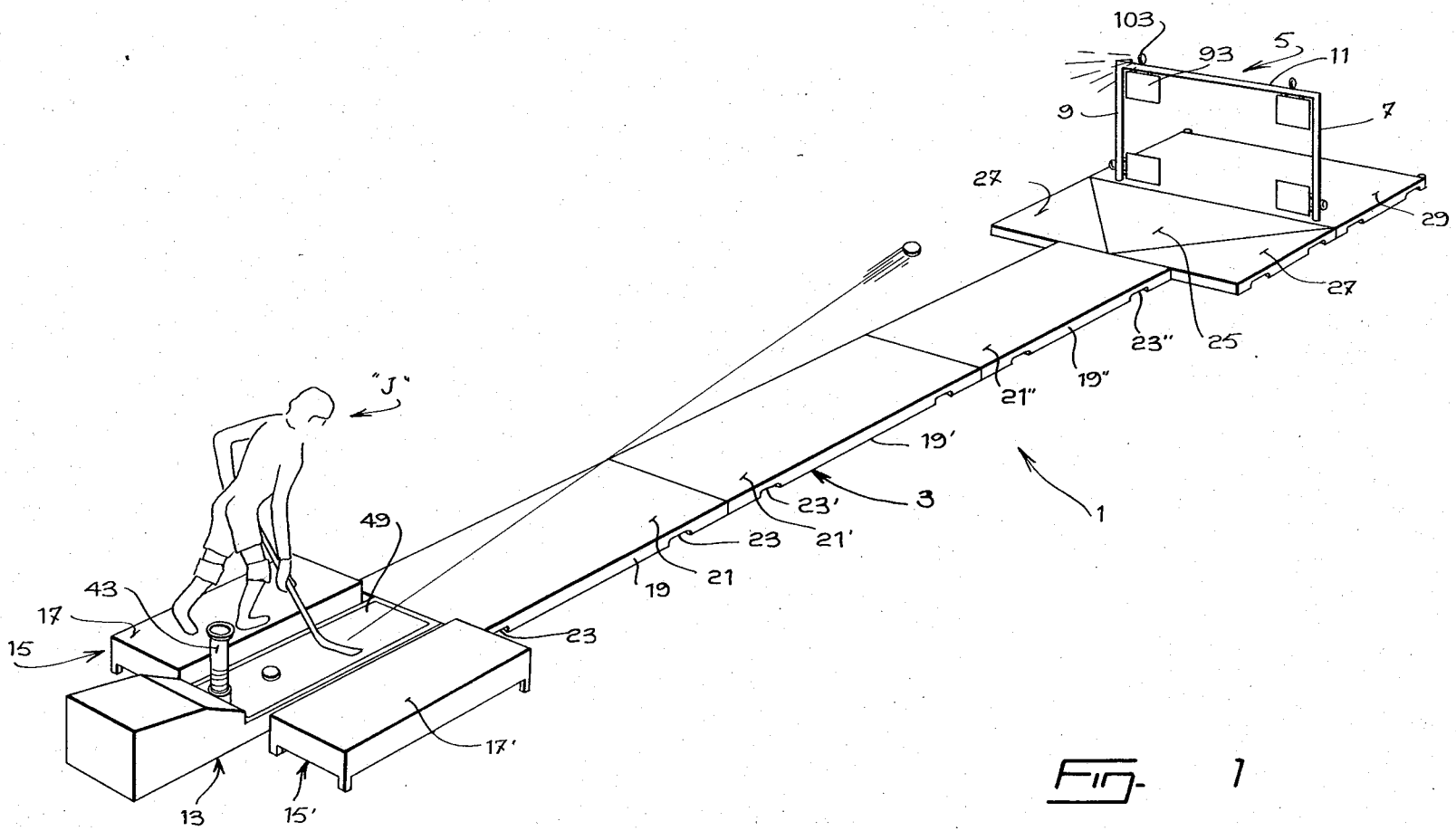
FIG. 1 is a perspective view of an apparatus according to the invention for practicising hockey shots out of a rink.

The exercising apparatus shown in FIG. 1 is intended to be used by one or several hockey players for practicising their shots to a goal. This apparatus comprises four main components, namely: a lane structure 3, a goal structure 5 mounted at one end of the lane; a device 13 located at the other end of the lane for dispensing pucks one by one to a hockey player and two platform 17 and 17' located close to the puck dispensing device 13 for receiving a hockey player J who wants to practice his shots. The platforms 17 and 17' are intended to allow this hockey player to throw each of the pucks dispensed by device 13 with his hockey stick.

The lane structure 3 comprises a plurality of modular elements 19, 19' and 19'' each provided with fixation means at each end to allow them to be connected to each other end to end. As shown in greater details in FIG. 2, the fixation means at each end of each modular element 19 comprises two hooks 31 capable of positively engaging two corresponding holes 33 provided at the other end of each modular element.

Advantageously, each element 19 extends at a short distance from over the ground and is provided with an upper surface 21 perfectly smooth to provide playing conditions substantially identical to those encountered by the players when practicising on ice.

To facilitate the installation and dismantling of the lane, recesses 23 can be provided as handles close to each end of each element 19.

The number of elements 19 used when assembling the lane depends on the players or coach's requirement for practice. Usually, three modular elements each having 8 feet long by 4 feet width will be sufficient to allow a hockey player to practice under conditions substantially similar to those encountered when playing on a rink.

The goal structure 5 mounted at one end of the lane comprises two vertical posts 7 and 9 connected at their upper ends by an horizontal bar 11. The sizes of this post and horizontal bar are of course selected so as to conform with the NHL regulations. The posts 7 and 9 are preferably mounted onto a supporting panel 29 substantially identical to each of the modular element 19. The connection between the end of the lane 3 and the panel 29 supporting the goal structure can be made with one or more connecting elements 25, 27 and 27'. The element 25 which has an upper surface extending at the same level as the upper surfaces of the element 19 and panel 29, preferably has the shape of an isocelis triangle. The other connecting elements 27 and 27' also have the shape of isocelis triangle. However, their size is selected to make them easily connectable to the element 25 as shown in FIG. 1, to form with this element a composite panel having substantially the same surface and shape as the panel 29.

Assembling of the connecting elements 25, 27 and 27' as shown in FIG. 1 permits to position the lane 3 right in front of the goal structure 5. By removing one of the connecting elements 27 and 27', it is possible to position the lane 3 at angle with respect to the goal structure 5, simply by positioning the end of the lane 3 directly onto one side of the connecting element 25. As can be seen in FIG. 3, the lane in this particular arrangement extends at angle either to the right or left with respect to the goal structure and thus allow the hockey player to practice his shots from the right side or left side of the goal structure.

The panel 29 and the connecting elements 25, 27 and 27' can be provided with hooks 31 and with corresponding holes 33 to make them positively connectable directly to each other in any possible position as shown in FIG. 3.

If desired, a rigid screen 35 can be located behind the goal structure 5 to stop the shots made by the player G and thus avoid that the shots cause damages behind the goal structure when these shots miss the goal structure.

The device located at the other end of the length is used for dispensing pucks 31 one by one. This device which is shown in greater details in FIGS. 4 and 5 comprises a frame 37 provided at one end with a hooking system 39 compatible with the hooks 31 of the modular elements 19 of the lane. The frame 37 is also provided at the other end with two rollers 41 for use in rolling the device over the ground as a wheeled-barrow whenever necessary.

A container 43 for storing pucks is mounted substantially in the middle of the frame 37. This container comprises a vertical hollow tube 59 in which may be stacked up several pucks. The hollow tube 59 is located adjacent to the end of an endless belt 49 extending between the puck storing container 43 and the end of the lane 3 opposite to the goal structure for moving each puck delivered from the container to said end of the lane. This endless belt 49 comprises a conveying belt 55 mounted onto two cylinders 51 and 53 that are themselves respectively mounted under the puck storing container 43, and close to the end of the lane 3. The cylinder 51 is rotatably driven by a motor to move the conveying belt 55 in the requested direction, as will be described hereinafter in greater details. The upper surface of the endless belt on which lay the pucks R moving from the container 43 towards the end of the lane 3, extends substantially in the same plane as the upper surface 21 of the elements 19 forming the lane 3. Indeed, it is compulsory that the upper surface of the endless belt 49, the upper surface of the lane 3 and the upper surfaces of the connecting elements 27 and 29 be at the same level to form an uniform, flat surface substantially similar to the ice surface of a rink, to ensure training conditions substantially similar to those encountered when practising onto a rink.

Advantageously, a rigid reinforcing plate 57 is positioned under the upper surface of conveying belt 55 to reinforce the same and avoid that it gets deformed by the weight of the pucks R and/or the impact of the hockey stick at every shot.

The pucks stacked in the hollow tube 59 are pushed one by one onto the endless belt which move them up to the end of the lane 3. This pushing is made by a pusher 45 moving to and fro along guiding rails 63. The pusher 45 is located at the bottom of the hollow tube 59 to push forward the lower puck located in the tube until it "falls" onto the endless belt, through lateral opening 61 provided in the lower end of the hollow tube 59. When the pusher 45 moves backwards and reaches the end of its stroke, all the remaining pucks stacked up in the hollow tube fall down by gravity, thereby providing another puck to be delivered in front of the opening 61 through which it will be pushed by the pusher 45 when the same comes back forwards. To provide this to and fro movement to the pusher 45, an electrical motor 45 is provided. This motor 45 is set to rotate at constant speed and thus operate the pusher 45 at constant interval via a gearing down device 71 connected to a rotating cam 69. This cam 69 in turn operates a connecting rod 65 pivotably mounted onto an axis 67. The pusher 45 is itself connected at the end of thus rod. As can be easily understood in FIG. 5, rotation of the cam 69 causes the connecting rod 65 to move the pusher 45 to and fro.

The motor 47 also drives the endless belt 49, via the gear down device 71 a driving belt 75 mounted between a pulley 73 connected to the outlet of the device 71 and another pulley 75 fixed at the end of the driving cylinder 51 of the endless belt 49. Selection of the diameter of the pulleys 73 and 77 is made to move the endless belt 49 at a speed compatible with the speed at which the pucks R are pushed onto the endless belt 55 by the pusher 45.

Thus, as clearly shown in FIGS. 2 and 3, the upper surface of the endless belt 49 forms a "shooting support" where a player J may practice his shots.

The platforms 17 and 17' are advantageously positioned on both sides of the endless belt 49 to allow, the players to practice their shots from left or right. The lengths of the endless belt 49 and of the platforms 17 and 17' are advantageously selected so that the player's freedom to choose a type of swing is unencombered. By way of example, the platform 17 and 17' may be six feet long and two feet 5 inches wide.

According to important feature of the invention, the upper surface of the platform 17 and 17' on which stand the hockey players, are positioned at a higher level that the upper surface of the endless belt 49, that is at a higher level than the surface on which are dispensed the pucks. The purpose of the difference of height is to place the players practicising with conventional shoes under conditions very similar to those encountered when practicising with skates. Therefore, the difference of height between the upper surface of the platform 17 and 17' and the upper surface of the endless belt 49 is selected to be substantially equal to the height of the skates that the hockey players will put on when actually playing on a rink. Generally, this difference of height is equal to 3 inches.

Advantageously, the goal structure 5 may be provided with a plurality of targets to force the players to improve their accuracy.

As shown in FIG. 6, the goal structure 5 preferably has four vertical targets 91, 93, 95 and 97 mounted in such a manner as to "cover" the four corners of the goal. The target 91 is connected to the post 9 by means of a hinge 111. The target 93 is connected to the transversal bar 11 by means of a hinge 113. In a similar manner, the target 95 is connected to the transversal bar 11 by means of a hinge 115 and the target 97 is connected to the post 7 by a hinge 117. Visual means consisting in small lamps 101, 103, 105 and 107 are mounted close to each of the targets 91, 93, 95 and 97 respectively. These lamps are connected externally onto the post and bars close to the corresponding targets and are designed to safely resist to the impact of a puck.

Figure 4:
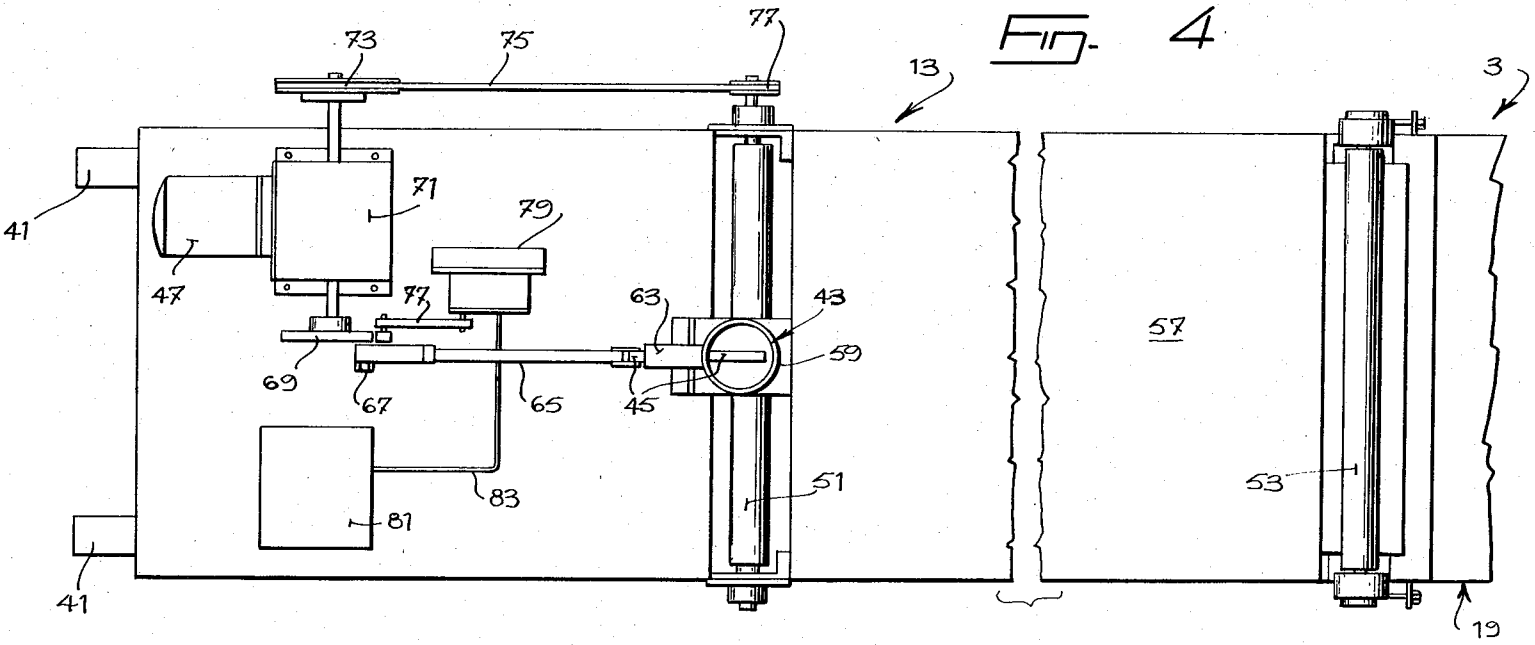
FIG. 4 is a top plan view of the puck dispensing device used in the apparatus shown in FIG. 1.
Figure 5:
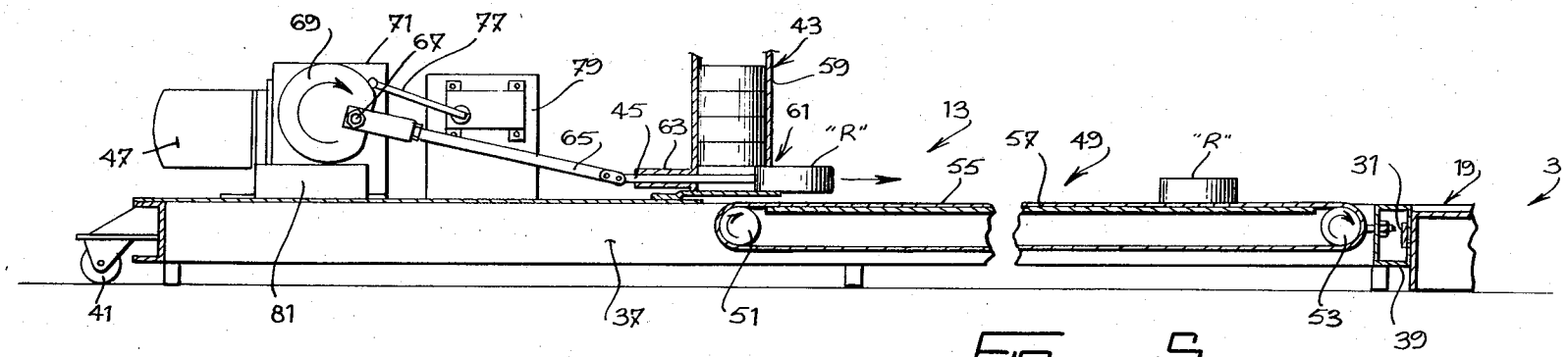
FIG. 5 is a side elevational view of the puck dispensing device shown in FIG. 4.

Each of these lamps is connected to an electrical control circuit 81 that can be located in the same housing as the motor 47 of the puck dispensing device 13. This electronic control circuit 81 is intended to operate the visual means, that is to switch on the lamps one after the other in any preprogrammed, sequential order, even repeatively, at the same speed as the one at which the pucks are dispensed, to indicate to the player who wants to practice which one of the targets he must try to aim at. Thus, by way of example, switching on of lamp 103 at the same time as a puck is delivered onto the endless belt 49 is a visual indication for the player J to aim at the target 93 located in the upper left corner of the goal. Similarly, switching on of the lamps 107 is an indication for the player to aim at the target 97 located at the bottom right corner the goal. To provide proper synchronisation of the visual means operation and of the delivery of pucks onto the endless belt 55, a switch 79 may be provided as shown in FIGS. 4 and 5. The switch 79 is controlled an operating lever 77 provided at one end with a small roller following the periphery of the cam 69. One complete rotation of the cam 69 moves the lever 77 which, in turn, operates the switch 79. The switch then gives an impulsion via a cable 83, to the control circuit 81 to switch on one of the lamps. This lamp will remain switched on until the cam has made another complete rotation and moves again the lever 77. At this time, another puck shall be delivered onto the endless belt and another lamp corresponding to another target, or, in some cases, to the same target will be switched on according to the preset program of the control circuit.

Advantageously, an audible signalisation device may be provided to give the player an audible signal every time a puck has reached the target corresponding to the lamp switched on.

To do so, an electrical circuit as shown in FIG. 7 can be provided for every lamp, although this circuit has been shown in the drawings only in the case of the lamp 103 and its corresponding target 93. When the electronic control circuit indicates that target 91 must be aimed at, an electrical impulse is sent to a switch 87 which closes a first circuit to switch on the lamp 103 and simultaneously, closes a second circuit including, in series, an electro sensible breaker 123 and a bell 89. If the puck, actually hits the target 93 corresponding to the lamp 103 switched on, the oscillating movement generated by the impact of the puck onto the target 93 mounted on its hinge 113 operates the breaker 123 which in turn closes the circuit on which is connected the bell 87 to ring the same. The particular position of the switch 87 between the two circuits of each target ensures that the belt is ranged only of the target corresponding to the lamp switched on has been hitten.

Figure 8:
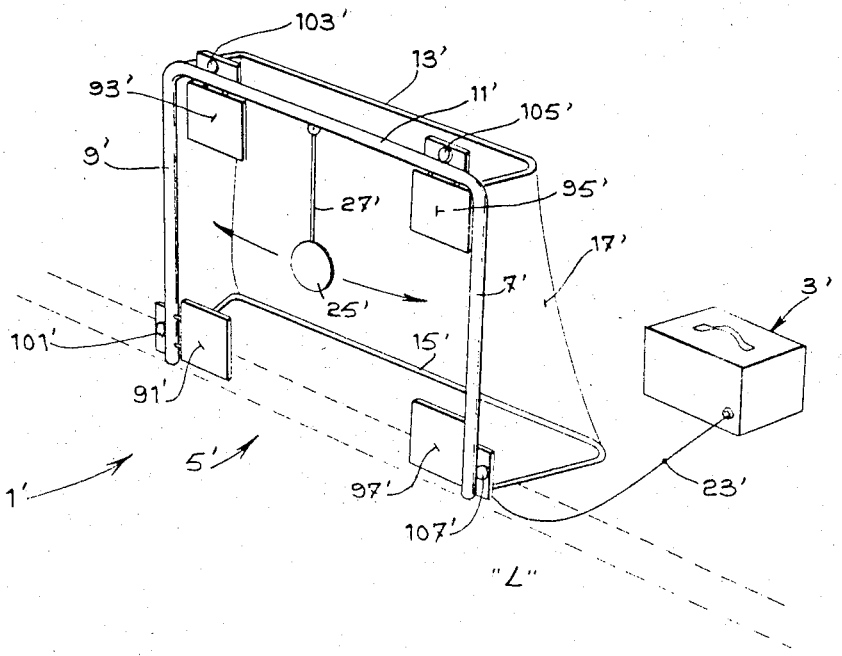
FIG. 8 is a perspective view of another apparatus according to the invention for practicising hockey shots in or out of a rink.

The other exercising apparatus 1' shown in a very general manner in FIG. 8 is also intended to be used by one or several hockey players to improve their shots. This apparatus 1' comprises two main components, namely a goal structure 5' provided with targets, and an electronical control circuit located in a portable box 3', this circuit being connected to the goal structure 5' by means of a cable 23'.

The goal structure 5' is intended to be substituted for a conventional goal structure located close to the ends of a rink, and to be mounted substantially in the same manner through the pins that are usually provided for this purpose on the blue lines of the rink. This goal structure 5' comprises two posts 7' and 9' having their upper ends connected by an horizontal bar 11'. The dimension of the posts and horizontal bar are selected to be standard and thus to correspond to the dimension of a regular hockey goal. The goal structure 5' also comprises two support rods 13' and 15' extending behind the frame defined by the blue line L of the rink, the posts 7' and 9' and the horizontal bar 11'. These rods 13' and 15' that can have any shape, are essentially intended to support and held a net 17' behind the goal structure to stop the pucks thrown within the frame.

Like the previously described goal 5, the substitution goal 5' is provided with at least two vertical targets mounted onto the posts and/or horizontal bar so as to extend inside the frame of the goal. As shown in FIG. 8, the goal 5' however preferably has four vertical targets 91', 93', 95' and 97' connected to the posts and bar with hinges so as to "cover" the four corners of the goal. Four lamps 101, 103', 105' and 107' are associated to each of the target 91', 93', 95' and 97' respectively. These lamps are mounted in small tubes of metal externally connected to the frame of the goal structure close to their corresponding targets, and are especially designed to resist impacts by the pucks.

Each of these lamps is connected to the electronic control circuit located in the box 3'. The utility, structure and operation of this electronical control circuit is identical to the utility, structure and operation of the circuit 81 previously described. Accordingly, this electronical control circuit shall not be described again in details.

To improve training of the hockey players, more than four targets may be provided for. Thus, by way of example, another target (not shown) can be provided in the middle of each post and bar. A target 25' may also be mounted to the lower end a pendulum 27' capable of oscillating at substantially the same level as are usually located the hands of a goal keeper. These targets may also be associated to further lamps connected to the electronical control circuit substantially in the same manner as are the lamps of the targets 91' to 97'.

As can now be understood, the apparatus 1 according to the invention as shown in FIGS. 1 to 7 is particular interesting in that it allows one or several players to practice their shots out of a rink, under conditions very similar to those encountered when actually practising onto such a rink. This apparatus 1 also permits to the players to improve the accuracy of their shots toward some particular points of the goal frame.

As can also been understood, the other apparatus 1' according to the invention as shown in FIG. 8 is particularly interesting in that it allows one or several players to practice their shots onto the rink, under conditions very similar to those encountered when playing again another team and with the possibility of practicising their shots against one or other very specific part of the goal. This apparatus 1' can be used alone in substitution of one of the conventional goal mounted onto a hockey rink, or in combination with an apparatus as shown in FIGS. 1 to 7.

Of course, numerous modifications can be made to the above mentioned embodiments of the invention, while remaining within the scope of the present invention. Thus, in the case of the apparatus 1' of FIG. 8, a foot operated switch can be provided for monitorizing the electronical control circuit and thus allowing a coach to accelerate or slow down the speed at which the lamps are switched on. Similarly, in the apparatus 1 of FIGS. 1 to 7, a monitoring device can be incorporated to the electrical supply of the motor of the puck dispensing device to adjust the speed of this motor and therefore the speed at which the pucks are dispensed according to the competency of the players. This monitoring device may also include a foot operated switch to operate the motor and thus causes distribution of pucks one by one or by groups of two or three.

What is claimed is:

1. An exercising apparatus for use by hockey players to practice their shots, comprising:

a lane structure made of a plurality of modular elements provided with fixation means for connecting them end to end;

a goal structure mounted at one end of the lane, said goal structure comprising (a) two vertical posts and a horizontal bar of regular dimensions (b) four vertical targets respectively mounted in the internal corners of the goal structure, and (c) four visual means associated with said four targets, respectively;

a puck dispensing device located at the other end of the lane for dispensing a plurality of pucks one by one;

at least one platform positioned adjacent to the puck dispensing device for receiving a hockey player who wants to practice his shots and allowing this hockey player to throw each dispensed puck toward the goal structure with a hockey stick, said platform having an upper surface positioned for simulating during the exercise, the height of the skates that the hockey player puts on when actually playing on a rink; and an electronic control circuit for operating said visual means one after the other in any sequential order, even repetetively, at substantially the same speed as the one at which the pucks are distributed by the dispensing device, for visually indicating to the players which target amongst said four targets they must try to aim at.

2. The apparatus of claim 1, wherein the puck dispensing device comprises:

a container for storing pucks;

an endless belt extending between the puck container and the end of the lane opposite to the goal structure for moving each puck delivered from the container to the said end of the lane, said endless belt having an upper surface substantially at the same plane as the upper surface of the lane; and a pusher operated by a motor for dispensing the pucks one by one from their container onto the endless belt.

3. The exercising apparatus of claim 2, wherein the motor is set to rotate at constant speed and operate the pusher at constant interval by means of a cam.

4. The exercising apparatus of claim 3, wherein the container for storing pucks consists of a vertical hollow tube in which may be stacked up several pucks, said hollow tube being mounted at the end of the endless belt which is opposite to the end of the lane, said hollow tube comprising an opening in its lower end through which the pusher may push the lower puck stacked up onto the endless belt, the pushed puck being immediately replaced by fall of the puck immediately superior thereto when the pusher moves back and reaches the end of its stroke.

5. The exercising apparatus of claim 4, wherein the motor operating the pusher also operates the endless belt.

6. The exercising apparatus of claim 2 wherein two platforms are positioned on both sides of the endless belt of the puck dispensing device respectively to allow the players to practice either from right or left and wherein the endless belt of the puck dispensing device further comprises a rigid reinforcing plate extending under its upper surface to prevent any deformation of said upper surface by impact with the hockey stick.

7. The exercising apparatus of claim 1, wherein the modular elements forming the lane structure include at least one connecting element for positioning the lane right in front of the goal structure or at angle with respect thereto.

8. The exercising apparatus of claim 1, wherein the electronic control circuit comprises an audible signaling system electrically connected to a set of contacts mounted on each of the targets to give an audible signal to the hockey player every time his puck hits a target designated by the visual means.

9. The exercising apparatus of claim 1, wherein the electronic control circuit includes means for adjusting the speed at which the visual means associated to each target are successively operated to take into account the player's speed.

10. The exercising apparatus of claim 1, wherein said four visual means are each externally mounted onto one of said two posts and/or onto the horizontal bar close to the associated target.

* * * * *